United States Patent [19]

Coffman

[11] Patent Number: 4,579,130

[45] Date of Patent: Apr. 1, 1986

[54] TOBACCO FILTERS AND METHOD FOR PRODUCING SAME

[75] Inventor: Paul M. Coffman, Houston, Tex.

[73] Assignee: Shell Oil Company, Houston, Tex.

[21] Appl. No.: 564,606

[22] Filed: Dec. 22, 1983

[51] Int. Cl.[4] ..... A24D 3/08; A24D 3/10

[52] U.S. Cl. ..... 131/332; 131/341; 131/343; 131/345

[58] Field of Search ..... 131/331, 332, 341, 343, 131/345; 156/180, 441, 301, 306, 182

[56] References Cited

U.S. PATENT DOCUMENTS

| | | | |
|---|---|---|---|
| 3,038,478 | 6/1962 | Touey et al. | 131/332 |
| 3,039,908 | 6/1962 | Parmele | 131/343 |
| 3,595,245 | 7/1971 | Buntin et al. | 131/332 |
| 3,960,770 | 6/1976 | Raley | 131/332 |
| 4,261,373 | 4/1981 | Tamauki et al. | 131/332 |

FOREIGN PATENT DOCUMENTS

| | | | |
|---|---|---|---|
| 0693929 | 9/1964 | Canada | 131/332 |

*Primary Examiner*—V. Millin

*Attorney, Agent, or Firm*—Jennifer R. Daunis

[57] ABSTRACT

A process is provided for producing cigarette filters which exhibit desired adhesion properties between the filter fibers, and which may be subjected to a substantially broader operating range during a temperature melt fusion step. A crystalline propylene polymer and a second crystalline polymer are mixed together, and the blend is extruded into fibers which are then heated to a temperature above the original melting point of the second crystalline polymer and below the original melting point of the crystalline propylene polymer. The fibers are twisted and/or crimped to effectuate desired adhesion between the fibers and are subsequently formed into filter rods which display greatly increased cohesiveness.

19 Claims, 2 Drawing Figures

TOBACCO FILTERS AND METHOD FOR PRODUCING SAME

BACKGROUND OF THE INVENTION

This invention relates to a method for producing tobacco filters. More particularly, it relates a method for producing cigarette filters which exhibit increased cohesiveness between the fibers of the tobacco filter, as a result of heat-induced adhesion.

An acceptable tobacco smoke filter, particularly a cigarette filter, must exhibit a high degree of filtration of tobacco smoke particles, i.e., have high smoke removal efficiency, at an acceptable draw resistance, i.e., pressure drop. The filter must also be capable of economical continuous production. Further it must be at a firmness sufficient to avoid collapse during smoking and must not unduly distort the taste and odor of tobacco smoke. The increasing use of filters in cigarettes not only for the purpose of removing tars and other undesirable substances from the tobacco smoke but also to save the cost of the tobacco which would otherwise be thrown away in the butt-end, has lead to the investigation and development of many kinds of filters. Cigarette filters need to resist damage by high speed making machinery, need to exert less than a certain degree of hindrance to the passage of tobacco smoke on drawing and yet must remove an adequate proportion of the undesirable substances. In addition, the filters should not have such a high pressure drop that the effort to draw smoke through each filter is noticeable to the smoker.

Cigarette filters made of crimped paper or cellulose acetate tow have met with some commercial success, although these entail the use of relatively complex machinery for handling the loose starting materials which must be rolled in paper or otherwise bound together into the desired shape of filter before being incorporated into the cigarette. This particular type of filter can also be comparatively heavy.

Cigarette filters made of cellulose acetate require the use of a costly solvent such as a triacetin solvent, in order to provide desirable adhesion bonding between the fibers of the filter. Such adhesion bonding of the fibers within the filter is important in producing the highly desirable back pressure (the "drag" of the cigarette) which is necessary to effectuate desired filtration of tar and other impurities. During the typical method of manufacture of many filters, air pressure is blown through the fibers to "fluff out" the fibers. The use of 100% polypropylene results in a lack of necessary air resistance, since there is no tackiness or desired adhesion between the fibers. Thus, adequate drag cannot be created.

Also known is the method disclosed in Tamaoki et al, U.S. Pat. No. 4,261,373 which provides a method of making cigarette filters by intially extruding only polypropylene fiber and then extruding separately from polypropylene a second component fiber such as an ethylene vinyl acetate copolymer, forming a fiber bundle of the separately extruded polypropylene fiber and second component fiber, and subjecting the fiber bundle to heat between the melting point of the polypropylene fiber and the melting point of the second component fiber. However, the method in '373 does not direct itself to the unique problem inherent in the use of tobacco filters, in that, the method of '373 suffers from the inherent disadvantage of a low and extremely narrow operating range at which fusion between the extruded polypropylene fiber and the extruded second component fibers can occur in order to get necessarty fiber adhesion.

It is well known that the individual melting points of polypropylene and polybutylene, for example, differ by some 40°-50°, the melting point of polybutylene being about 130° C. and the melting point of polypropylene being from about 170° C. to about 180° C. depending upon whether the polymer has been stretched. When the lower melting point component (polybutylene, for example) is heated to its melting point which is 40°-50° C. below the melting point of polypropylene, it (polybutylene) begins to melt very rapidly and decrease in viscosity almost immediately, as is typical of crystalline polyolefins. However, while the polybutylene is melting, the temperature is not sufficiently high to reach the fusion point of polypropylene, such fusion point being within approximately 3°-4° C. of the melting point of polypropylene. This results in a melting of the lower melting poing polymer (polybutylene), onto the higher melting point polymer (polypropylene), which is still in a solid form. The only operating range in which the polypropylene can fuse to the polybutylene is the fusion range of approximately 3°-4° C. below the melting point of polypropylene. This results in the necessity of maintaining the operating temperature within an extremely narrow range, as well as constant supervision of the operating temperature control. Thus, operation at a temperature too high results in a fiber puddle much like a puddle produced from melted candle wax, while operation at temperatures too low results in polybutylene melted to solid polypropylene. Such a melt does not result in effective fusion nor does it impart weld strength to the fiber. These disadvantates result from the use of two separatly extruded fibers, each separately extruded fiber continuing to maintain two distinct melting points while in the form of the filter.

SUMMARY OF THE INVENTION

The present invention resides in a method for producing tobacco filters which exhibit desired tackiness and adhesion properties between the filter fibers and which may be subjected to a lower and a substantially broader operating range during the temperature melt fusion step which promotes the cohesiveness of the fibers within the filters.

In the present invention, a crystalline propylene polymer and a second crystalline polymer, the second crystalline polymer having a melting point less than the melting point of the crystalline propylene polymer, are first mixed together to produce a homogeneous blend, the blend then having its own separate melting point below the original melting point of the crystalline propylene polymer and above the original melting piont of the second crystalline polymer, due to the nature of the polymer blend. The polymer blend is then extruded into fibers. The fibers are formed into a tow and heated to a temperature above the original melting point of the second crystalline polymer and below the original melting point of the crystalline propylene polymer to effectuate adhesion and good weld strength between the fibers of the tow. The operating range within which this fusion of fibers occurs is within a range of about 40° which results in a lowered and, most importantly, broadened operating range at which the fusion can occur. While still within the fusion temperature range of the blend, the fibers of the tow are twisted and/or crimped to effectuate further desired adhesion of the tow and are subsequently formed into filter rods which display greatly increased cohesiveness.

It is an object of the present invention to provide an improved tobacco smoke filter which exhibits increased adhesion between the fibers of the tobacco filter.

It is another object of the present invention to provide an improved and simpler method of manufacturing tobacco smoke filters which exhibit increased adhesion between the fibers of the filter.

A further object of the present invention is to provide a tobacco smoke filter as well as a method for making the same which comprises fibers made from a mixture of polypropylene and some other appropriate crystalline polymer, where the fibers exhibit low density and high transfer strength among themselves and yet where the use of such filters and method for making the filters results in economic inherent savings heretofore inherent only in the use of 100% polypropylene alone.

It is an even further object of the present invention to provide a method of manufacturing tobacco smoke filters which exhibit increased tackiness and adhesion from twisting, crimping and melt fusion, whereby the operating range of temperatures at which fusion of the polymer can occur is substantially broadened from about 3°–4° C. to about 40° C., resulting in increased ease of operation and more effective fusion between the polymers.

Still another object of the present invention is to provide a tobacco smoke filter and method of manufacturing tobacco smoke filters which reqire less filter material and which need not be wrapped as tightly as other known filters require.

Other objects not specifically set forth herein will be obvious to the skilled artisan upon reading the Detailed Description of the Invention with reference to the drawings.

DRAWINGS

DETAILED DESCRIPTION OF THE INVENTION

Basically, the method of manufacturing tobacco filters involves the initial mixing of a crystalline propylene polymer and a second crsytalline polymer together into a homogeneous blend. The melting point of the crystalline propylene polymer should be higher than the melting point of the second crystalline polymer. The second crystalline polymer may be a butene-1 polymer, an ethylene polymer, or copolymers or tripolymers thereof. Other polymers of suitable melting points not therein named may also be used as the second crystalline polymer. Hereinafter, the butene-1 polymer (polybutylene) will be referred to as the second crystalline polymer, although it is to be understood that the butene-1 polymer is used merely as an example of the polymers which may be used.

Figure 1:
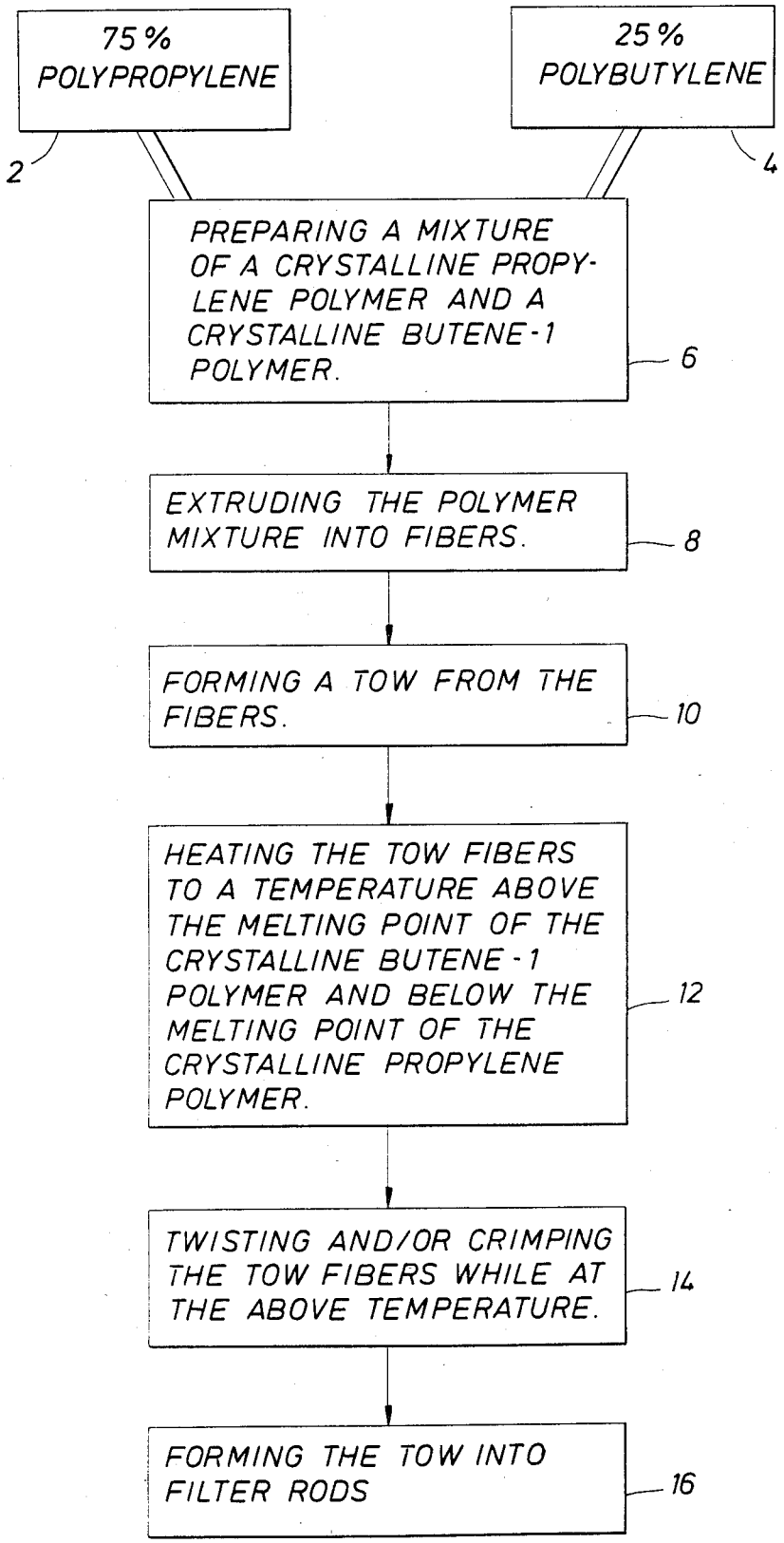
FIG. 1 is a flow diagram for the method of preparing the filter from a blend of polypropylene and polybutylene.

There is shown in FIG. 1 a schematic view of the apparatus for manufacturing the tobacco filter made in accordance with the present invention. Pellets of each of the two polymers are physically mixed together to form a homogeneous mixture as may be seen in FIG. 1. FIG. 1 illustrates the example of a mixture 6 of 75% polypropylene 2 and 25% polybutylene 4 pellets. The polymer mixture is passed through extruder 8 and the fibers are formed into a tow 10. The tow fibers are heated 12 to a temperture which are both above the initial melting point of the second crystalline polymer (polybutylene), yet below the original melting point of the crystalline propylene polymer. As FIG. 1 further illustrates, the tow fibers are twisted and/or crimped 14 while at the above temperature, and subsequently the tow is formed into tobacco filter rods 16.

Figure 2:
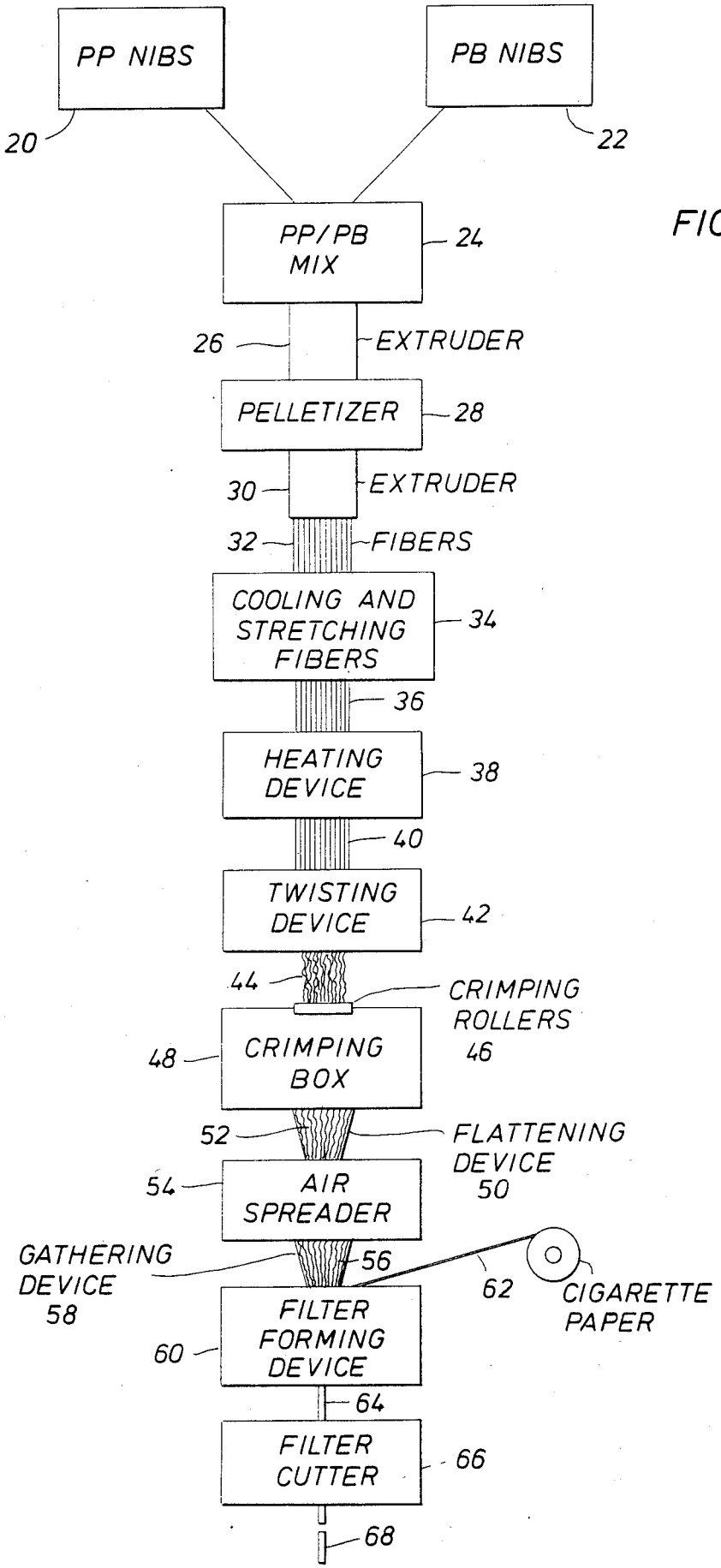
FIG. 2 is a detailed flow diagram for the method of producing the polypropylene/polybutylene blend tobacco filters.

Referring now to FIG. 2, the polypropylene pellets 20 and the polybutylene pellets 22 are mixed together prior to any extrusion. Examples of polymers which may be used as the first component include polypropylene type polymers such as crystalline polypropylene, propylene ethylene copolymer, propylene butene-1 copolymer, propylene ethylene butene-1 copolymer, etc. The melting point of the crystalline propylene polymer should be higher than the melting point of the second crystalline polymer selected. In the case of polypropylene and polybutylene, the melting point of polypropylene is approximately 170° C., however, the melting point changes according to the orientation of the polymer so that the melting point of polypropylene, if stretched, may be as high as 180° C. The melting point of polybutylene is approximately 130° C. The fusing point of polypropylene is approximately 3°–4° C. less than its melting point, as is also true of the relation of the fusing point to the melting point of polybutylene.

The percent of the crystalline propylene polymer in the mixture relative to the percent of the second crystalline polymer may be from about 25% by weight of about 95% by weight and the percent of the second crystalline polymer in the mixture relative to the percent of the crystalline propylene polymer may be from about 5% by weight to about 75% by weight. More preferred percents may be from about 50% by weight to about 85% by weight of crystalline propylene polymer and from about 10% by weight to about 50% by weight of the second crystalline polymer. Most preferably, the crsytalline polymer percent from about 70% by weight to about 80% by weight and the second crystalline polymer percent from about 20% by weight to about 30% by weight.

The polypropylene/polybutylene mix 24 is extruded 26 and then passed through a pelletizer 28 where each pellet produced contains, for example, 75% polypropylene and 25% polybutylene. In addition, each resulting polypropylene/polybutylene blend pellet now has a melting point reduced from the original melting point of the pellets initially used that were 100% polypropylene. The blended 75% polypropylene, 25% polybutylene pellets are then gathered in a hopper and mixed well to insure homogeneity. The mixed pellets of 75% polypropylene and 25% polybutylene are then extruded 30 into fibers. This extrusion may take place by the conventional process or by a non-conventional (in-line) process.

The extruded fibers 32 are then cooled and stretched 34. Such stretching affects the orientation and thus the melting temperature of the amount of polypropylene in the fibers. The tensile strength of polypropylene is usually about 5,000 p.s.i. but when polypropylene, even if in a blend with polybutylene, is stretched, the tensile strength increase may be as great as ten-fold. Such a stretching may result in a raise of the original melting point of polypropylene from about 170° C. to about 180°

C. The fibers may be formed to give a variety of cross-sections to the fiber bundles.

The fibers 36 of the tow are then heated 38 to a temperature which is above the melting point of the second crystalline polymer (polybutylene) and yet below the melting point of the crystalline polypropylene polymer to effectuate inter-fiber adhesion. Most preferably, the tow is heated to about 145° C.

Next, the tow of heated fibers 40 is passed through a twisting or crimping device 42. During the twisting or crimping of the heated tow fibers 40, the heated tow fibers 40 are maintained at or near the temperature to which they were raised in heating device 38. Thus, the twisting or crimping, takes place while the two fibers 40 remain at a temperature above the melting point of the second crystalline polymer (polybutylene) and below the melting point of the crystalline proplyene polymer. The tow fibers 40 may be both twisted and crimped if desired. The twisting and/or crimping further promotes adhesion bonding and cohesion between the tow fibers 40 which already exhibit tackiness from being subjected to heating device 38 at temperatures above the melting point of the second crystalline polymer (polybutylene) and below the melting point of the crystalline propylene polymer. Twisting device 42 may be any suitable means for twisting the tow fibers 40. The twisting may be varied in degree and in intensity according to the amount of bonding desired.

The twisted fibers 44 are then passed through crimping rollers 46 into crimping box 48, where twisted fibers 44 may be optionally crimped mechanically. The number of crimps in waves per 25 mm may be determined according to the amount of crimping desired, as well as the percent ratio of the fiber mixture. Inside of crimping box 48, back pressure is regulated to crimp as desired to produce within a flattening device 50 a crimped tow 52, which tow may have 50,000 ends.

The crimped tow 52 is spread side-ways by flattening device 52 and is then passed through air spreader 54 where crimped tow 52 is subjected to a blast of air blown through the fibers of crimped tow 52 through air pressure to "fluff out" the fibers of crimped tow 52. It is important that the fibers of crimped tow 52 provide resistance to the air flow from air spreader 54 so that the fibers of crimped tow 52 will "fluff out" as desired. This "fluffing out" step is desirable since it results in cigarette filters with the amount of back pressure necessary to create the drag desired when smoked. The air pressure resistance in the polypropylene/polybutylene blend of crimped tow 52 the tackiness exhibited by the fibers from heating the fibers to a temperature above the melting point of second crystalline polymer (polybutylene) and below the melting point of the crystalline propylene polymer, as well as the twisting and/or crimping steps. The choice of the particular fibers to be used in making these filters, then, becomes critical since creation of back pressure (and therefore drag) is directly dependent upon the "fluffing out" of the fibers as a result of the air flow resistance exhibited through the tackiness of the fibers. For example, a 100% polypropylene tow filter provides little, if any, resistance to the air flow of air spreader 54 because none of the desired tackiness is exhibited by pure polypropylene, as is exhibited by a blend of polypropylene with polybutylene, for example. Thus, 100% polypropylene used alone in a tobacco filter does not exhibit the necessary weld strength as does the blend of the present invention.

After crimped tow 52 is subjected to air spreader 44, the spread tow 56 is fed into a gathering device 58, for example a funnel, and reduced to the size of the filter desired through filter-forming device 60. The filter produced is produced in the shape of a rod and at the same time is wrapped with suitable filter paper 62. The resulting paper-warpped filter rod 64 is then passed through a filter cutter 66 and the individual filter rods 68 are subsequently collected.

The invention is illustrated by the following examples. All parts and proportions are by weight except where otherwise stated. These examples are presented for the purpose of illustration only and are not to be taken as in limitation of the present invention.

EXAMPLE 1

PREPARATION OF FILTERS

Crystalline 100% polypropylene pellets and crystalline 100% polybutylene pellets are mixed together to form a homogeneous mixture which is 75% by weight polypropylene and 25% by weight polybutylene. The mixture is extruded at 225° C. The extruded product is then subjected to a pelletizer at ambient temperature which results in homogeneous pellets each of which comprises 75% by weight polypropylene and 25% by weight polybutylene. The resulting pellets are then extruded into fibers at 225° C. The fibers are cooled and stretched and a multiplicity of the fibers are gathered together in the form of a tow, which is then heated to 145° C. While still at approximately this temperature, the fibers are twisted and then subjected to a crimping box by passing the bundles of fibers through feed rolls of the crimping box. The back pressure in the crimping box may be regulated to crimp the amount as desired. The crimped tow produced contains approximately 50,000 ends.

The crimped tow of fibers is spread side-ways in a flattening trough and passed through an air spreader where air pressure is blown through the fibers to "fluff out" the fibers and create back pressure.

The "fluffed out" tow is fed into a funnel and reduced to 20 mm lengths of cigarette filter. The filter lengths are then wrapped with cigarette paper and subjected to a filter cutter which cuts them into the appropriate lengths.

EXAMPLES 2–5

Examples 2 through 5 involve the testing of 100% polypropylene fibers (Example 2), blended fibers of 90% polypropylene and 10% polybutylene (Example 3), blended fibers of 75% polypropylene and 25% polybutylene (Example 4) and blended fibers of 50% polypropylene and 50% polybutylene (Example 5).

The above weight percent blends of fibers were prepared in accordance with Example 1. The fibers were cooled and stretched after extrusion and formed into tows. All four tows were hung in an air oven, the temperature of which was raised progressively from 130° C. to 160° C. When the fibers reached 160° C., the tows were removed and each inspected for tackiness and adhesion between the fibers.

Next the tows were subjected to a hot press and pressure of 10 psi and subsequently inspected. The tows were cooled to room temperature and manually tested by exerting pulling forces on the tows transverse to the fiber direction. The below chart serves to illustrate the results of these tests:

TABLE 1

COMPARISON OF DEGREES OF ADHESION AND RELATIVE COSTS FOR VARIOUS POLYMERS

| Polymer Component | Degree of Adhesion | Relative Cost of Materials |
|---|---|---|
| 100% polypropylene | nonexistent | very low |
| 90% polypropylene/ 10% polybutylene | good | low |
| 75% polypropylene/ 25% polybutylene | excellent | average |
| 50% polypropylene/ 50% polybutylene | excellent | high |

EXPERIMENT 6

Blends of 25% polybutylene (PB 0200) and 75% polypropylene (PP 5520) as well as 50% polybutylene ethylene copolymer (PB 8640) and 50% polypropylene ethylene copolymer (PP 7522) were made in accordance with Example 1 into tapes which have orientations comparable with those of fibers. These blends, as well as 100% polypropylene (PP 5520), were heated above the melting point of polybutylene but below the melting point of polypropylene. Under pressure of 400 p.s.i., the blends were welded by placing them on heated press platens against silicon rubber on one side and steel on the other to distribute the press load. Welding was done with specimens oriented parallel, as well as perpendicular, to one another for 4 minutes. As may been seen in the chart below no significant difference in weld strength is noted between the polybutylene/polypropylene blends. The blends were subjected to temperatures as high as 183° C. It is noteworthy that the actual melting point of stretched polypropylene is increased a substantial number of degrees above its original melting point of 170° C. It is also noteworthy that the blend of polypropylene and polybutylene not only prevents this from occuring, but reduces and substantially broadens the temperature range to which the blend must be subjected in order for good welding (tackiness and adhesion) to occur. The 100% polypropylene shows no weld strength (adhesion) even at temperatures (>180° C.) substantially higher than its melting point.

TABLE 2

STRETCHED TAPE ADHESION PROPERTIES AFTER WELDING PRESS TIME 4 MINUTES PRESSURE 400 PSI.

| | PRESSED TEMPERATURE °C. | WELD STRENGTH (ADHESION) LBS./IN |
|---|---|---|
| MATERIAL A | | |
| (25% PB 0200/ 75% PP 5520) | 23 | — |
| | 157 | >.1 |
| | 162 | 0.1 |
| | 165 | 0.2 |
| | 177 | 1.5 |
| | 183 | could not separate |
| Material B | | |
| (50% PB 8640/ 50% PP 7522) | 23 | — |
| | 146 | 0.6 |
| | 157 | 1.0 |
| | 162 | 1.6 |
| | 165 | 1.4 |
| | 169 | 2.0 |
| Polypropylene | | |
| (100% PP 5520 stretched 8/1) | >180 | |

Filters prepared by the above method may be used in product applications other than just cigarette filters. It is to be understood that the foregoing detailed description is given merely by way of illustration and that many variations may be made therein without departing from the spirit and scope of the invention.

What is claimed is:

1. A method of manufacturing tobacco filters which comprises:

mixing a substantial amount of a crystalline propylene polymer and a second crystalline polymer, where the melting point of said second crystalline polymer is less than the melting point of said crystalline propylene polymer;

extruding said mixture into fibers;

forming a tow from a multiplicity of said fibers;

heating said fibers of said tow to a temperature above said melting point of said second crystalline polymer and below said melting point of said crystalline propylene polymer to effectuate some inter-fiber adhesion;

twisting or crimping said fibers of said tow while said temperature remains above said melting point of said second crystalline polymer and below said melting point of said crystalline propylene polymer to effectuate adhesion between said fibers of said tow; and forming said tow into filter rods, whereby said fibers in said rods exhibit increased cohesiveness.

2. The method of claim 1, wherein the amount of said crystalline propylene polymer is from about 25% by weight to about 95% by weight and the amount of said second crystalline polymer is from about 5% by weight to about 75% by weight.

3. The method of claim 1, wherein the amount of said crystalline propylene polymer is from about 50% by weight to about 85% by weight and the amount of said second crystalline polymer is from about 10% by weight to about 50% by weight.

4. The method of claim 1, wherein the amount of said crystalline propylene polymer is from about 70% by weight to about 80% by weight and the amount of said second crystalline polymer is from about 20% by weight to about 30% by weight.

5. The method of claim 1, wherein said second crystalline polymer is selected from the group consisting of butene-1 polymer, ethylene polymer, or copolymers thereof.

6. The method of claim 1, wherein said fibers of said tow are both twisted and crimped.

7. A tobacco filter having cohesive fibers in said filter made in accordance with the process of claim 1.

8. A method of manufacturing tobacco filters which comprises:

mixing from about 25% by weight to about 95% by weight of a crystalline propylene polymer and from about 5% by weight to about 75% by weight of a crystalline butene-1 polymer;

extruding said mixture into fibers;

forming a tow from a multiplicity of said fibers;

heating said fibers of said tow to a temperature above the melting point of said second crystalline polymer and below the melting point of said crystalline propylene polymer to effectuate some inter-fiber adhesion;

twisting or crimping said fibers of said tow while said temperature remains above said melting point of said second crystalline polymer and below said melting point of said crystalline butene-1 polymer to effectuate desired adhesion between said fibers of said tow; and forming said tow into filter rods, whereby said filters exhibit increased cohesiveness.

9. The method of claim 1, wherein the amount of said crystalline propylene polymer is from about 50% by weight to about 85% by weight and the amount of said second crystalline polymer is from about 10% by weight to about 50% by weight.

10. The method of claim 1, wherein the amount of said crystalline propylene polymer is from about 70% by weight to about 80% by weight and the amount of said second crystalline polymer is from about 20% by weight to about 30% by weight.

11. The method of claim 8, wherein said fibers of said tow are both twisted and crimped.

12. A tobacco filter having cohesive fibers in said filter made in accordance with the process of claim 8.

13. A method of manufacturing tobacco filters which comprises:

mixing from about 70% by weight to about 80% by weight of a crystalline propylene polymer and from about 20% by weight to about 30% by weight of a crystalline butene-1 polymer;

extruding said mixture into fibers;

forming a tow from a multiplicity of said fibers;

heating said fibers of said tow to a temperature above the melting point of said second crystalline polymer and below the melting point of said crystalline propylene polymer to effectuate some inter-fiber adhesion;

twisting and crimping said fibers of said tow while said temperature remains above said melting point of said second crystalline polymer and below said melting point of said crystalline polypropylene polymer to effectuate desired adhesion between said fibers of said tow; and forming said tow into filter rods, whereby said filters exhibit increased cohesiveness.

14. A tobacco filter having cohesive fibers in said filter made in accordance with the process of claim 13.

15. A tobacco filter which comprises a cohesive tow of extruded fibers of a mixture of a crystalline propylene polymer and a second crystalline polymer manufactured by heating said fibers of said tow to a temperature above the melting point of said crystalline polymer and below the melting point of said crystalline propylene polymer and twisting or crimping said fibers of said tow while said temperature remains above said melting point of said second crystalline polymer and below said melting point of said crystalline propylene polymer to effectuate adhesion between said fibers of said tow.

16. The tobacco filter of claim 15, wherein the amount of said crystalline propylene polymer is from about 25% by weight to about 95% by weight and the amount of said second crystalline polymer is from about 5% by weight to about 75% by weight.

17. The tobacco filter of claim 15, wherein the amount of said crystalline propylene polymer is from about 50% by weight to about 85% by weight and the amount of said second crystalline polymer is from about 10% by weight to about 50% by weight.

18. The tobacco filter of claim 15, wherein the amount of said crystalline propylene polymer is from about 70% by weight to about 80% by weight and the amount of said second crystalline polymer is from about 20% by weight to about 30% by weight.

19. The tobacco filter of claim 18, wherein said second crystalline polymer is selected from the group consisting of butene-1 polymer, ethylene polymer or copolymers thereof.

* * * * *